United States Patent [19]

Wissing

[11] Patent Number: 5,054,365

[45] Date of Patent: Oct. 8, 1991

[54] PROPELLANT IGNITER MAGAZINE FOR A WEDGE-TYPE BREECHBLOCK

[75] Inventor: Gerd Wissing, Düsseldorf, Fed. Rep. of Germany

[73] Assignee: Rheinmetall GmbH, Duesseldorf, Fed. Rep. of Germany

[21] Appl. No.: 546,939

[22] Filed: Jul. 2, 1990

[30] Foreign Application Priority Data

Jul. 1, 1989 [DE] Fed. Rep. of Germany ..... 3921767

[51] Int. Cl.[5] ..... F41A 19/57

[52] U.S. Cl. ..... 89/24; 89/26; 89/27.13; 89/33.03; 42/1.02

[58] Field of Search ..... 89/24, 26, 27.13, 33.03; 42/1.02

[56] References Cited

U.S. PATENT DOCUMENTS 4,452,123 6/1984 Holtrop et al. ..... 89/33.03
4,558,626 12/1985 Bervolles ..... 89/24

FOREIGN PATENT DOCUMENTS 3233749 3/1984 Fed. Rep. of Germany .

OTHER PUBLICATIONS

"Rheinmetall's Langesrohr Pentalateral 135 mm Artillery Ordnance for the 1990's" International Defense Review No. 5, 1989, pp. 653-655.

*Primary Examiner*—Stephen C. Bentley
*Attorney, Agent, or Firm*—Spencer & Frank

[57] ABSTRACT

A gun includes a gun barrel having a breech end; a wedge-type breechblock disposed at the breech end; a flash bore in the breechblock; a seal disposed adjacent to and surrounding an inlet opening of the flash bore; a firing mechanism mounted on the breechblock; a propellant igniter magazine removably receivable in the breechblock and including a housing and an endless guide channel defined in the housing; and a plurality of casings received in the guide channel. The casings are arranged in a side-by-side contacting relationship with one another; each casing having opposite open ends and a chamber for receiving a propellant igniter cartridge therein. There is further provided an advancing mechanism for step-wise advancing the casings in the endless guide channel for moving each casing into and out of a firing position in which a respective casing is in alignment with the flash bore and in engagement with the seal. The firing mechanism is arranged to ignite the propellant igniter cartridge contained in the casing that dwells in the firing position, whereby a propellant igniting flame passes from the cartridge through the flash bore.

12 Claims, 5 Drawing Sheets

PROPELLANT IGNITER MAGAZINE FOR A WEDGE-TYPE BREECHBLOCK

CROSS REFERENCE TO RELATED APPLICATION

This application claims the priority of Federal Republic of Germany Application P 39 21 767.1 filed July 1st, 1989, which is incorporated herein by reference.

BACKGROUND OF THE INVENTION

This invention relates to a propellant igniter magazine for a wedge-type breechblock. The magazine has an endless guide channel in which the propellant igniter cartridges are accommodated in a side-by-side arranged series and are stepwise advanced in the channel parallel to one another by a star-wheel. The latter, in turn, is incrementally advanced by a ratchet rotated by means of a stationary cam track as the breechblock is opened. Each firing of a propellant igniter is counted by a counting mechanism.

German Offenlegungsschrift 32 33 749.3 (published unexamined application), a counterpart to U.S. Pat. No. 4,558,626, discloses a propellant charge igniter magazine (primer cartridge magazine) for a wedge-type breechblock. That primer magazine has a straight magazine shaft for receiving the propellant charge casings. Owing to its straight, single row, shaft feed path, the magazine can only carry a limited number of casings (rounds), so that, for example, after just ten firings the spent magazine must be exchanged for a full one. Additional disadvantages of the magazine include that, for example, each primer round has to be displaced from the magazine into a chamber in the breech-block in order to be ignited, while at the same time for completion of the ignition step the magazine has to be moved transversely. Still further, the device requires that the casing of spent primer rounds have to be removed from the chamber so that a new primer round can be received.

There has already been a step in the direction to overcome the drawbacks described above. A primer charge igniter magazine is disclosed in International Defence Review, No. 5, 1989, page 655. The article discloses an advantageous construction for a magazine by the provision of an endless channel by which the capacity for storing primer rounds is increased. The rounds are advanced through the endless channel by use of a star-shaped control wheel. However, that article fails to disclose where the actual ignition of the further movable primer rounds should take place, nor does it disclose how the stepwise advancement should be carried out, nor how the coupling of various components be achieved, nor how the space-demanding cartridge indicator on the exterior of the magazine should be converted into a space-saving cartridge count indicator within the magazine itself.

SUMMARY OF THE INVENTION

It is an object of the invention to provide an improved magazine of the above-outlined type which, compared to prior art constructions, is simpler and provides more reliable stepwise advancement of propellant igniter cartridges, yet which also allows for ignition thereof within the magazine itself, and has a space-saving counting device (registration) for the spent cartridges disposed within the magazine.

This object and others to become apparent as the specification progresses, are accomplished by the invention, according to which, briefly stated, the propellant igniter magazine which is removably receivable in the breechblock of a gun barrel includes a housing and an endless guide channel defined in the housing; and a plurality of casings received in the endless guide channel. The casings are arranged in a side-by-side contacting relationship with one another; each casing having opposite open ends and a chamber for receiving a propellant igniter cartridge therein. There is further provided an advancing mechanism for step-wise advancing the casings in the endless guide channel for moving each casing into and out of a firing position in which a respective casing is in alignment with a flash bore in the breech and is in engagement with a seal surrounding the flash bore. The firing mechanism is arranged to ignite the propellant igniter cartridge contained in the casing that dwells in the firing position, whereby a propellant igniting flame passes from the cartridge through the flash bore.

Thus, each of the propellant igniter cartridges (hereinafter also referred to as propellant igniters) is received in a separate cylindrical sleeve (or casing) supported in the endless guide channel. The casings are preferably manufactured with close external tolerances for ensuring a high degree of parallelism for not only increasing the storage capacity of the magazine by a factor of, for example, three but also for ensuring that the advancement of the casings within the endless guide channel is problem-free.

The interior of the casings is formed as a chamber for the propellant igniters. Such an arrangement significantly simplifies the ignition process as compared to prior art arrangements, because the propellant igniters may be ignited exclusively inside the magazine in a position in which they are in registry with the ignition channel of the principal propellant without requiring a longitudinal displacement of the propellant igniter or a transverse displacement of the magazine.

Furthermore, when the propellant igniter is in its firing-ready position, a biasing positioning member, preferably a leaf spring, holds the casing in a play-free manner against a tooth groove of a control wheel moving within the magazine. This ensures that the propellant igniter always assumes the same centered position in its firing-ready position, for ensuring that there is a lasting sealing and an optimum ignition.

It is also desirable that the casings are retained within the magazine after ignition, as opposed to being disposed of in the environment in a environmentally taxing manner. According to the invention, the spent casings serve to advance the unignited propellant igniters remaining in the guide channel when the control wheel is advanced and, finally, when each propellant igniter has been ignited, the casings can be refilled with new igniters after removal of the spent magazine.

According to a further advantageous feature of the invention, for the stepwise advance of the control wheel, in the ratchet axially parallel shiftable form-fitting means, such as torque-transmitting pins are provided. By virtue of a preferably diametral disposition of the pins in the ratchet, a symmetric coupling engagement and thus a smooth torque transmission to the control wheel is possible. A retractable stop extending into a locking groove of the control wheel ensures a secure immobilization of the control wheel to allow the pins to slide back into their initial position.

According to still another advantageous feature of the invention, the counting mechanism for recording the spent igniters is, in a particularly space-saving manner, accommodated in the inner space enclosed by the endless guide channel, preferably in the upper curved zone thereof.

The entire magazine may the introduced in a simple manner from above into the guide grooves of the wedge-type breechblock and may be secured thereto by means of releasable screw connection in the breechblock. A manually engageable handle means provided at the upper zone of the magazine allows for easy manual handling.

DETAILED DESCRIPTION OF THE PREFERRED EMBODIMENT

Figure 1:
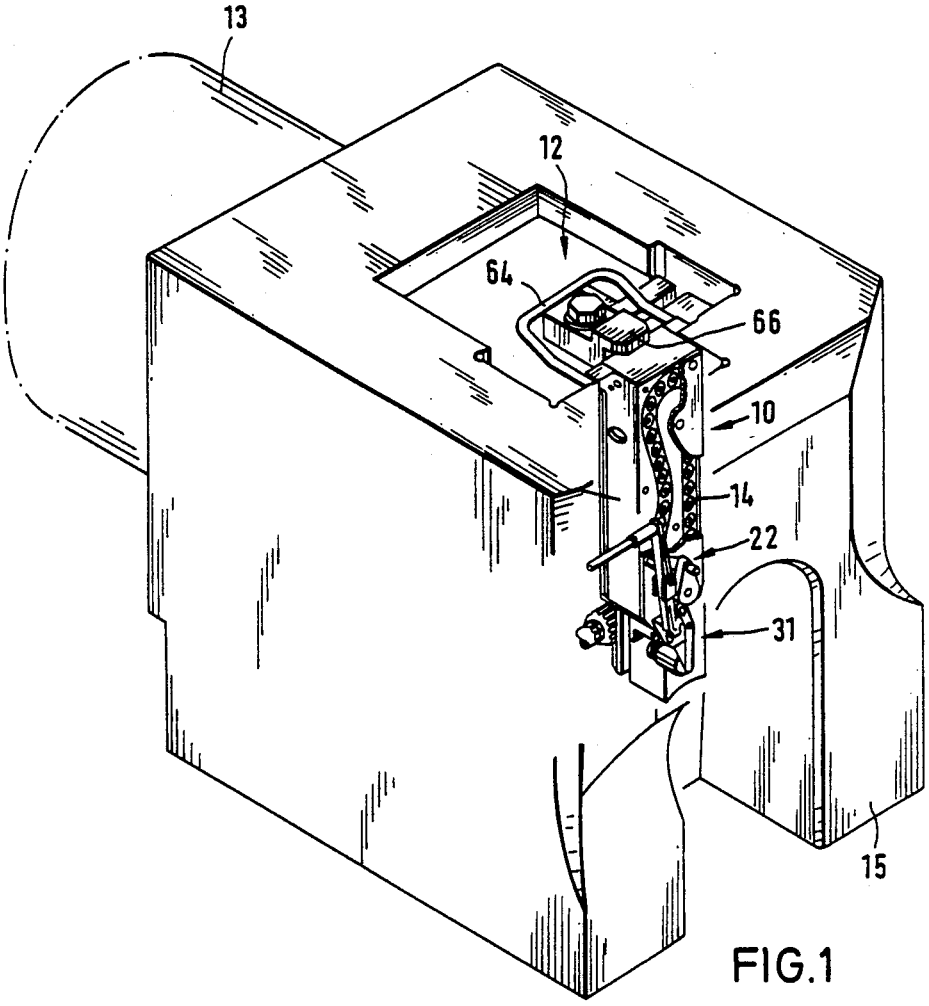
FIG. 1 is a perspective view of a wedge-type breechblock of a barrelled weapon, incorporating a preferred embodiment of the invention.

FIG. 1 shows the breech end of a gun barrel 13, preferably the gun barrel of a large caliber weapon (not shown) to which a breech ring 15 is attached. The latter supports a wedge-type breechblock 12 movable perpendicularly to the axis of the gun barrel for performing the loading action. A propellant igniter magazine 10 is attached to the back side of the breechblock 12 for the ignition of the propellant in the chamber of the gun.

Figures 2, 2A, 2B:
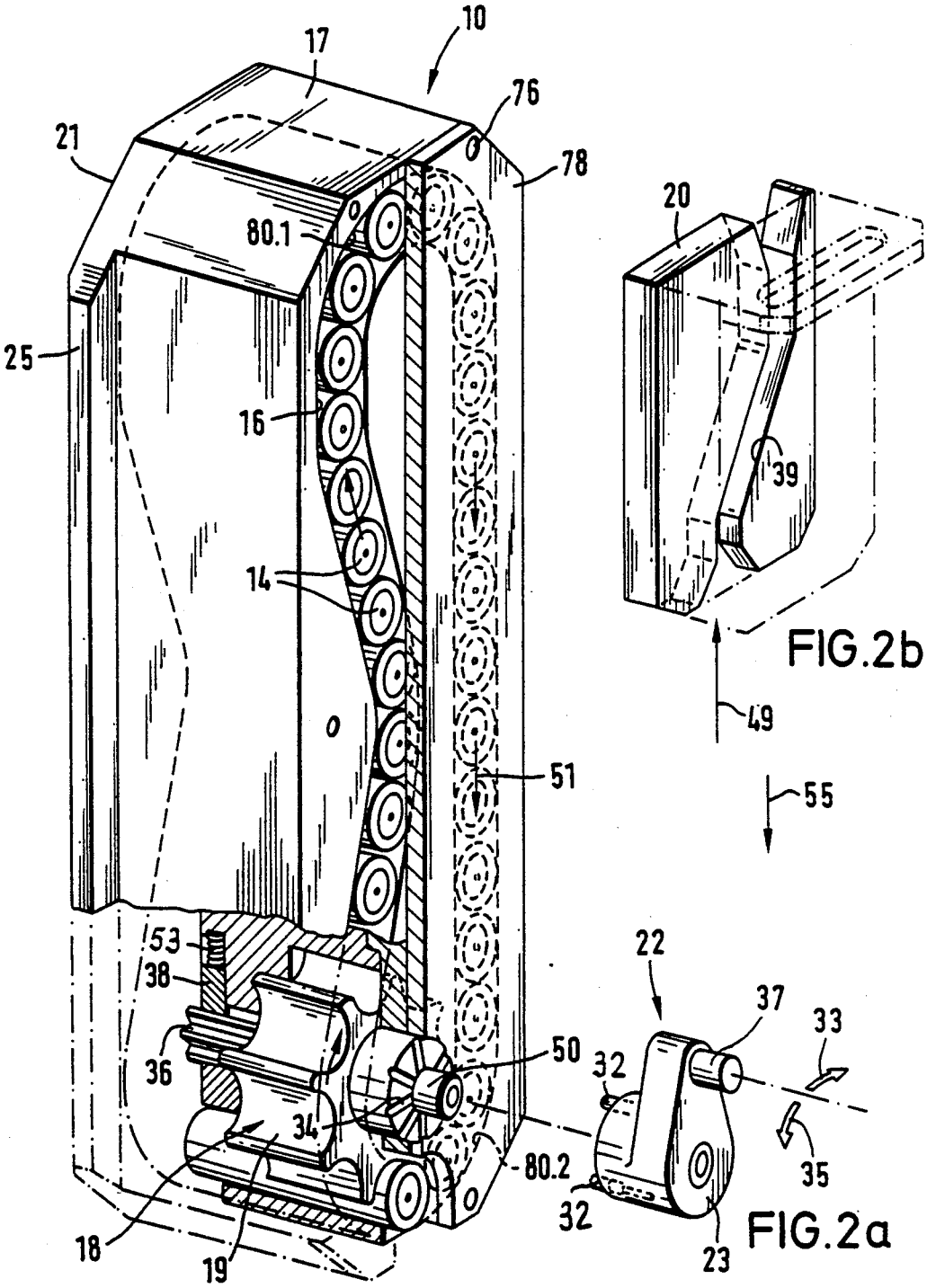
FIG. 2 is a perspective view of the preferred embodiment, shown on an enlarged scale.
FIG. 2*a* is a perspective view of a component of the preferred embodiment.
FIG. 2*b* is a perspective view of another component of the preferred embodiment.

A handle 64 allows the propellant igniter magazine 10 to be easily manually inserted in, and removed from the wedge-type breechblock 12, and a fastener 66 at the top of wedge-type breechblock 12 secures the propellant igniter magazine 10. FIG. 2 shows that the propellant igniter magazine 10 has an endless guide channel 16 through which propellant igniters 14 are moved stepwise by a star-shaped control wheel 18 which transports the igniters 14 to an ignition-ready position 28 (FIG. 6). The further transportation of the propellant igniters 14 is carried out by a ratchet 22 which will be described in greater detail below with reference to FIGS. 2–7. The ignition of propellant igniters 14 is carried out by a firing mechanism 31 which is described in more detail below with reference to FIGS. 8–11.

While FIGS. 2, 2*a* and 2*b* generally show the manner in which the propellant igniters 14 arranged in the propellant igniter magazine 10 are driven, FIGS. 3–7 show the particular manner in which the various actuating members drive the propellant igniters 14 in a stepwise fashion.

Reverting once again to FIGS. 1 and 2, a housing 17 of the propellant igniter magazine 10 includes an exterior front side 21 having guide rails 25 on both sides for guiding the magazine 10 during insertion into guide grooves (not shown) of the wedge-type breechblock 12. A cover 78 is detachably attached to the opposed face of the wedge-type breechblock 12 by fasteners such as screws 76.

Figure 7:
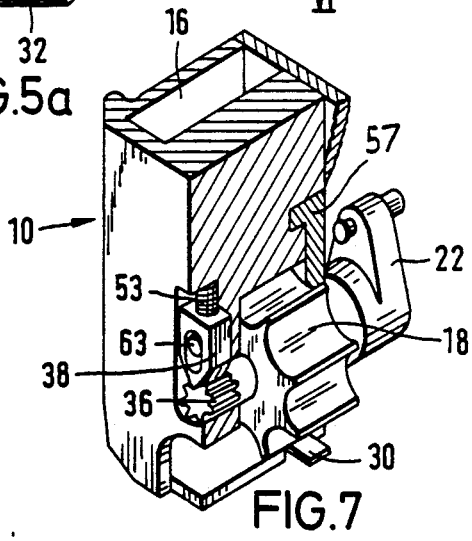
FIG. 7 is a sectional perspective view of a component of the preferred embodiment as viewed in the direction of arrow VII of FIG. 3.

Within the propellant igniter magazine 10 is the endless guide channel 16 which has upper and lower deflection zones 80.1, 80.2. Furthermore, in order to increase the storage capacity of the magazine 10 there is a large bend in one of the longer runs of the guide channel 16 so that a greater number of propellant igniters 14 can be carried. Alternatively, each of the two longer runs can be bent inwardly to still further increase the capacity of the guide 16 channel. Thus, the guide channel 16 in the embodiment shown in FIG. 2 has a kidney-shaped path and has a storage capacity of more than 30 propellant igniters 14. The guide channel 16 has a rectangular cross section as shown in FIG. 7.

Figure 9:
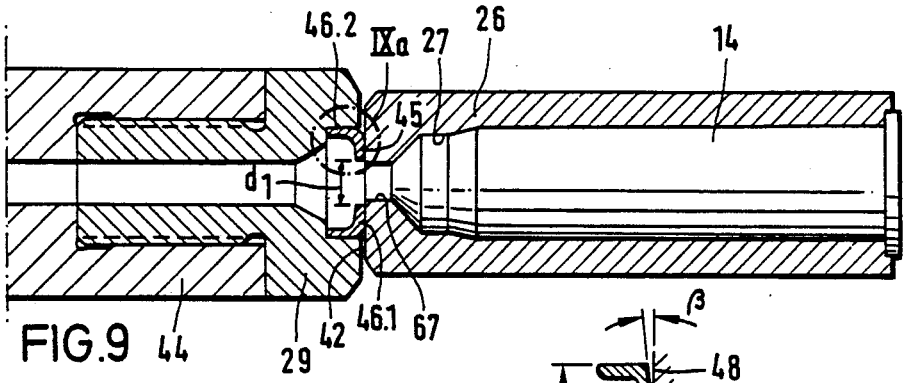
FIG. 9 is an enlarged sectional view of the inset IX in FIG. 8.
Figure 9A:
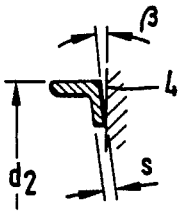
FIG. 9*a* is an enlarged sectional view of the inset IXa of FIG. 8.

Given that each of the propellant igniters 14 has a diameter of varying cross section, as best seen in FIG. 9, it is necessary to provide each igniter 14 with a sleeve-like casing 26 of constant outer diameter so that the propellant igniters 14 can be easily and smoothly stored and moved within the guide channel 16. The exterior regions of the casings 26 are easily manufactured to high tolerances, so that, as a result, even a large number of casings 26 stacked up on top of each other in a row in the guide channel 16 of rectangular cross section, a high degree of parallelism and, consequently, tilting-free and error-free movement of the casings 26 is possible.

Figure 3:
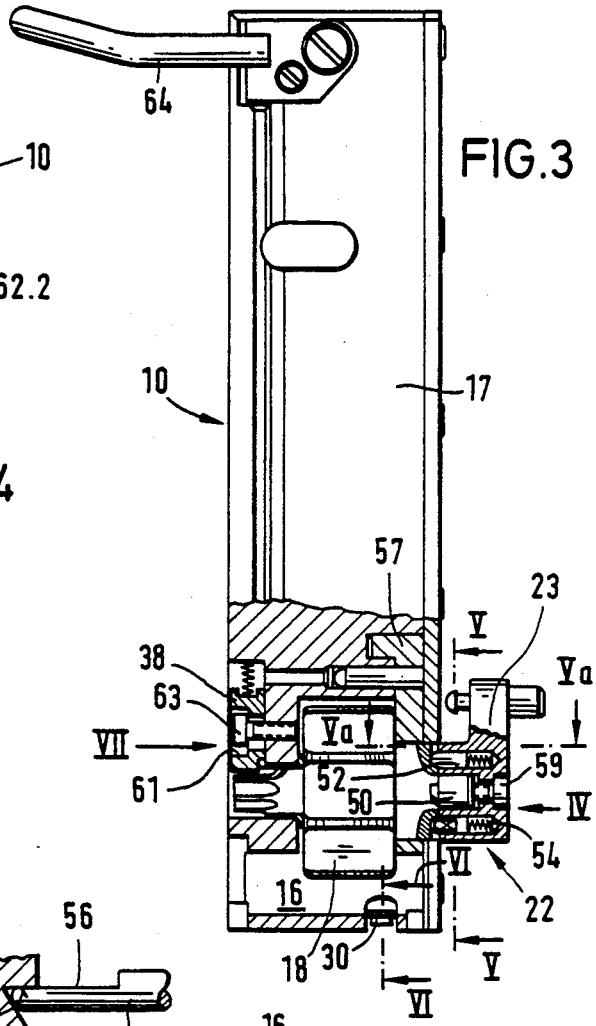
FIG. 3 is a partially sectional side elevational view of the preferred embodiment.

A star-shaped control wheel 18 for continued movement of the cartridges 26 within the guide channel 16 is adjacent to and partially fills the interior region of the lower deflection zone 80.2. The control wheel 18 has a plurality of axially parallel grooves (troughs) 19 arranged in a circumferential series, thus lending the control wheel 18 a star-shaped configuration. The control wheel 18 is rotatably attached to the propellant igniter magazine 10 on both sides, the one side of the control wheel 18 being operatively connected with the ratchet 22, and the other side of the control wheel 18 being operatively connected with a stop 38. As seen in FIG. 3, the ratchet 22 is rotatably attached to the control wheel 18 on the end of an axle which serves as a slide bearing 50. The ratchet 22 is operatively connected to the control wheel 18 so that when the ratchet 22 is rotated in a clockwise direction, as indicated by arrow 33, the control wheel 18 is advanced. When the ratchet 22 is rotated in an opposite, counterclockwise direction 35, the stop 38 prevents rotation of the control wheel 18.

Also referring to FIGS. 2*a* and 2*b*, movement of the ratchet 22 is initiated by the opening of the wedge-type breechblock 12 at the moment when a follower pin 37 attached to the ratchet 22 enters a cam track 39 provided in a cam plate 20 affixed to the breech ring 15 in a known manner (not shown). Thus, when the wedge-type breechblock 12 moves still further in direction 49, the follower pin 37 slides along the cam track 39 thus causing rotation of the ratchet 22 in a clockwise direction 33. In order that this rotational movement of the ratchet 22 is transmitted to the control wheel 18, the ratchet 22 has axially parallel and displaceable torque-transmitting pins 32 which engage in radial grooves 34 defined in an end face of the control wheel 18. During rotational movement of the control wheel 18 the casings 26 within tooth grooves 19 of the control wheel 18 are advanced in the direction of arrow 51, as are the other casings 26 stored in the guide channel 16.

Figure 5:
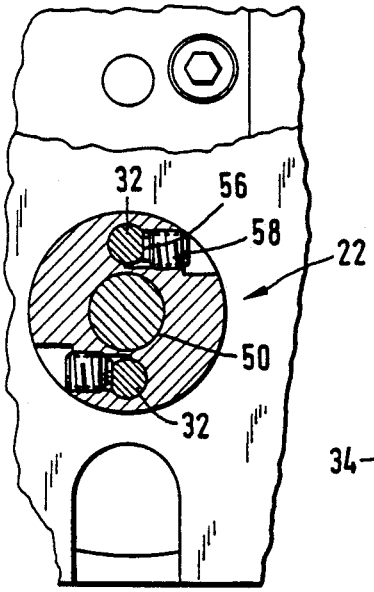
FIG. 5 is a sectional view taken along the line V—V of FIG. 3.
Figure 5A:
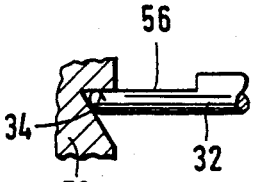
FIG. 5*a* is a sectional view taken along the line Va—Va of FIG. 3.
Figure 6:
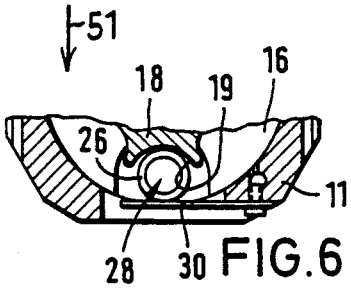
FIG. 6 is a sectional view taken along the line VI—VI of FIG. 3.

Referring now to FIGS. 3, 5 and 5*a*, the torque-transmitting pins 32 are contained within a ratchet housing 23 and are arranged within respective pockets 52 diametrically with respect to the slide bearing 50 of the control wheel 18. Each pin 32 is longitudinally displaceable, and an end face thereof contacts a compression spring 54. The upper end of each pin 32 is configured to mate with the grooves 34 of the control wheel 18. Thus, the grooves 34 have a saw-toothed configuration, whereas the pins 32 which engage therewith are partially flattened on one side for movement therewith, and are partially spherically rounded on the other side for facilitating their return movement. Each pin 32 further has a guide surface 56 extending in the longitudinal direction for abutting a setscrew 58 for preventing a rotation of the pin 32 and ensuring its trouble-free engagement and disengagement.

As shown in FIG. 7, on the side of the control wheel 18 opposite from the slide bearing 50, a plurality of locking notches or grooves 36 is provided which sequentially cooperate with the stop or detent pin 38 and whose number equals that of the radial grooves 34. Thus, the stop 38, which engages the locking notch 36 under the biasing action of a spring 53, restrains the control wheel 18 until the ratchet 22 returns to its starting position when the closing movement of the wedge-type breechblock 12 in direction 55 (FIG. 2*b*) is completed. Follower pin 37 of the ratchet 32 is thereby moved back along the cam surface 39 of the guide 20 whereby the torque-transmitting pins 32 slide back along an angled surface of the respective radial grooves 34 by virtue of their spherical shape and come to rest in the respective next grooves 34. The spring force of the spring 53 associated with the stop 38 is selected so that a disengagement of the stop 38 from the locking notches 36 and a subsequent engagement in the next following locking notch 36 for the desired stepwise advancement of the propellant igniters 14 in direction 51 are ensured.

FIGS. 3 and 7 show additional particulars of the invention, such as a bearing plate 57 secured to the housing 17 of the propellant igniter magazine 10 and supporting the control wheel 18 which is inserted into the bearing plate 57. The ratchet housing 23 is, to prevent an axial displacement thereof, attached to the control wheel 18 by means of a screw 59. In stop 38 a guide slot 61 is provided through which a screw 63 extends for attaching the stop 38 to the housing 17 and for guiding the stop 38 in its reciprocating motion in cooperation with the slot 61.

The handle 64, as shown in FIGS. 1 and 3, is hingedly attached to the upper end of the magazine 10 at both sides thereof. When the magazine 10 is installed in the breechblock 12, the handle 64 generally extends perpendicularly to the longitudinal direction of the magazine 10 into the free space at the upper half of the breechblock 12. Accordingly, owing to the flat construction of the handle assembly, there is a reduction in the amount of space required when the weapon is ready for firing. For ease of insertion and removal of the propellant igniter magazine 10 the handle 64 is upwardly foldable.

Figure 4:
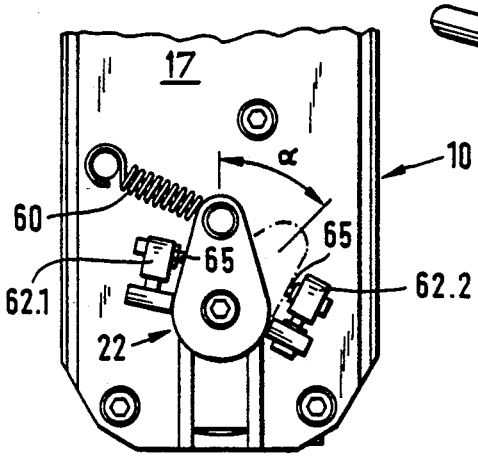
FIG. 4 is an end elevational view as viewed in the direction of arrow IV of FIG. 3.

Turning to FIG. 4, in order to adjust the exact end positions of the ratchet 22 there is a provided, on either side of the ratchet 22, pair of stops 62.1, 62.2 attached to the housing 17. Each stop has a setscrew 65. A spring 10 element 60 attached to the propellant igniter magazine 10 ensures that the ratchet 22 is at its starting position abutting against the stop 62.1. The required pivot angle $\alpha$ of the ratchet 22 for the stepwise advancing of the propellant igniter 14 can be accurately set, particularly also for a manual emergency operation.

FIG. 6 shows that the base 11 of the magazine 10 has a holding member 30 extending into the guide channel 16. The holding member is preferably a leaf spring extending in the direction of movement 51 of the casings 26 and is attached at one end to the base 11. The leaf spring 30 positions one of the casings 26, containing a propellant igniter 14, in the ignition-ready position 28 by resiliently pressing the casing 26 against one of the tooth grooves 19 of the control wheel 18. In that manner it is possible to use the propellant igniter magazine 10 not only in an essentially vertical orientation as previously described, but also in a wedge-type breechblock which is movable substantially transversely to the breech ring.

Figure 8:
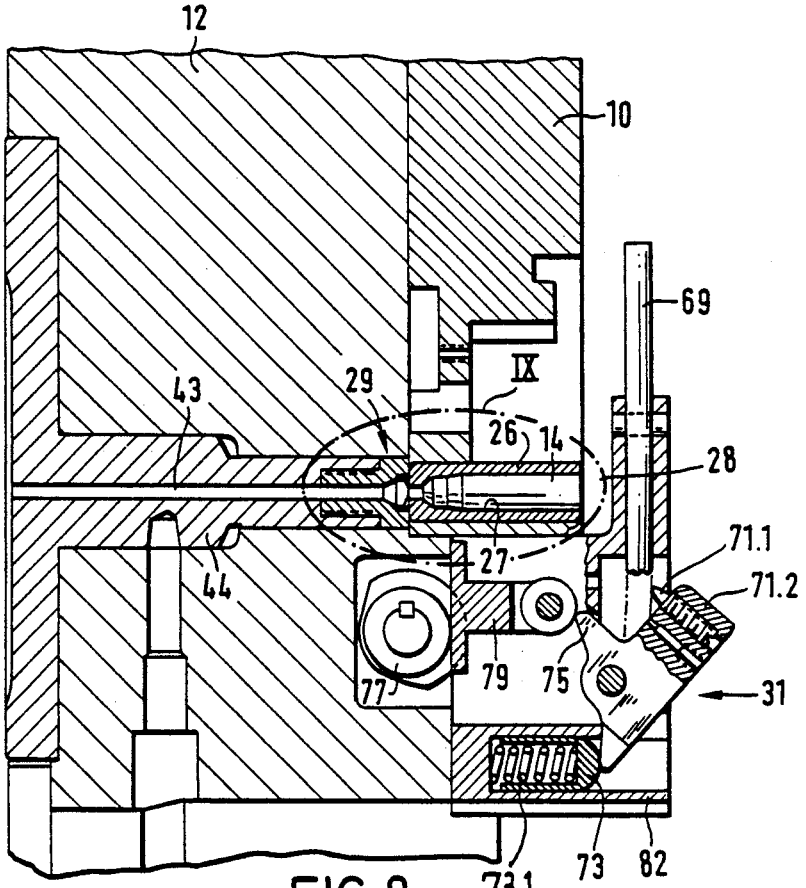
FIG. 8 is a fragmentary sectional side elevational view of the preferred embodiment and a wedge-type breechblock.

Given that each casing 26, as best seen in FIGS. 8 and 9, has its interior configured as a chamber 27 for receiving the propellant igniter 14 and in its ignition-ready position 28, has a front face 42 that engages a sealing member 29 and a back face for being operatively connected with the firing mechanism 31, the ignition of the propellant igniter 14 can take place directly in the propellant igniter magazine 10 in the ignition-ready position 28. The interior of the casing 26 mates with the exterior contour of the propellant igniter 14 and the ignition end of the propellant igniter 14 is oriented towards the firing mechanism 31. The front face 42 of the casing 26 that faces the barrel of the weapon is configured as a ring-shaped sealing surface which extends radially and which is designed to be aligned coaxially with the sealing element 29.

A good sealing action and a long service life, coupled with a particularly fast pressure buildup, yet realized with a comparatively small sealing surface, are achieved with the following parameters in a relaxed state: the distance between the radially extending flange 46.1 of ring obturator 45 and the front face 42 of the casing 26 is preferably 0.2 mm, and is at a maximum 0.5 mm; the outer face 48 of the flange 46.1 defines an outwardly open angle $\beta$ with respect to the radially extending front face 42 of the casing 26; the ratio of the bore diameter $d_1$ of the ring obturator 45 to its outer diameter $d_2$ is in the range of 0.35 to 0.5; and the wall thickness of the flange 46.1 is in the range of 0.8 to 1.2 mm. In a preferred embodiment the inner diameter $d_1$ of the ring obturator 45 is 5 mm, the outer diameter $d_2$ is 12 mm, the wall thickness of the flange 46.1 is 1 mm, the angle $\beta$ is 3° and the material employed is a high-grade, high-strength steel.

An initial linear disposition of the flange 46.1 against the front face 42 of the casing 26 ensures that there is a fast and secure sealing of the gap between the cross-sectionally L-shaped ring obturator 45 and the front face 42 of the casing 26 during pressure build-up. The necessary pressure build-up for sealing arises at first from the development of gases during ignition of the propellant igniter 14, which gases escape through the bore 67 out of the casing 26 into detonating channel or flash hole 43 leading to a build-up of pressure, which finally reaches its maximum value when gases are produced by the main propellant (not shown). When that pressure value is reached, the flange 46.1 of the ring obturator 45 is pressed against the sealing front face 42 of the casing 26 over its entire width.

Figure 11:
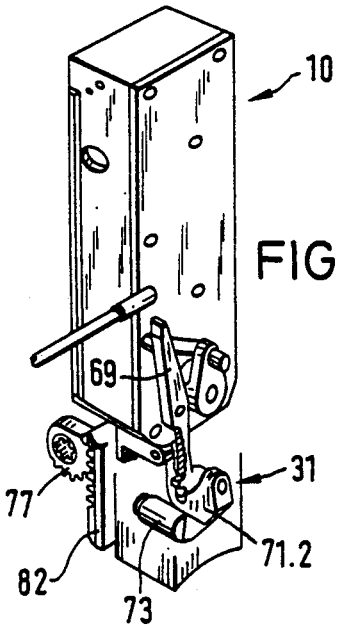
FIG. 11 is a view similar to FIG. 10, showing components in a different operational position.
Figure 10:
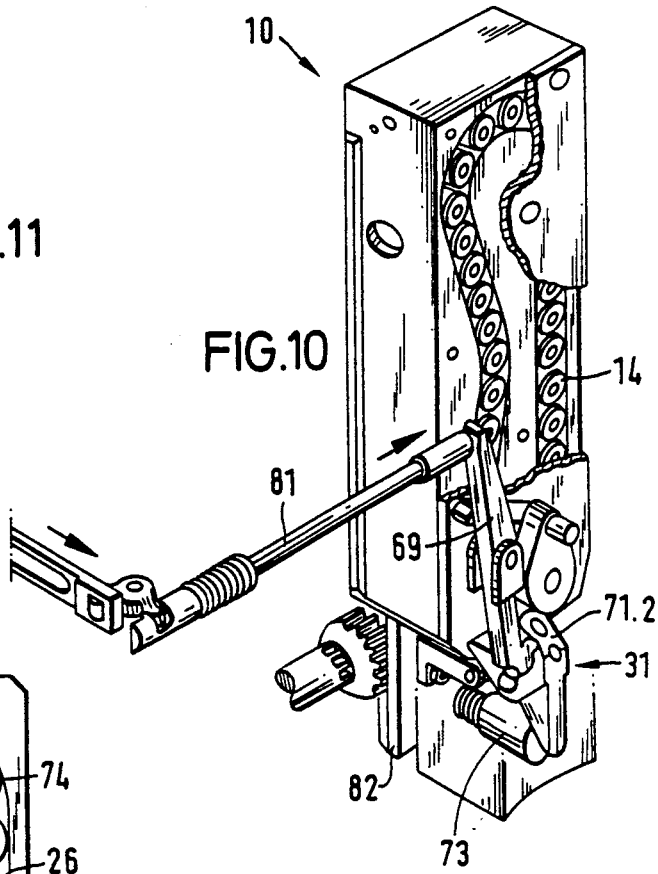
FIG. 10 is an enlarged perspective detail of FIG. 1.

The ignition of the propellant igniters 14, as shown in FIGS. 8, 10, and 11, is effected by the firing mechanism 31 which includes a sear or firing arm 69, a firing pin 71.1 carried by firing pin holder 71.2, a firing spring cap 73 having a biasing spring 73.1 therein, a cocking cam 75 attached to firing pin holder 71.2 for engaging a fixed lifting cam 79, and a raisable and lowerable housing 82 driven by a gear 77. FIGS. 8 and 11 show the firing pin holder 71.2 in a cocked position by which the firing pin holder 71.2 is secured by means of the lifting cam 79. FIG. 10 shows the housing 82 after an upward movement, whereby the firing pin holder 71.2 is in its released position relative to the lifting cam 79. In that released position, firing can occur by action of the sear 69, for example by means of a linkage 81, whereupon the firing pin 71.1 ignites the propellant igniter 14 placed in the firing-ready position 28.

Figure 12:
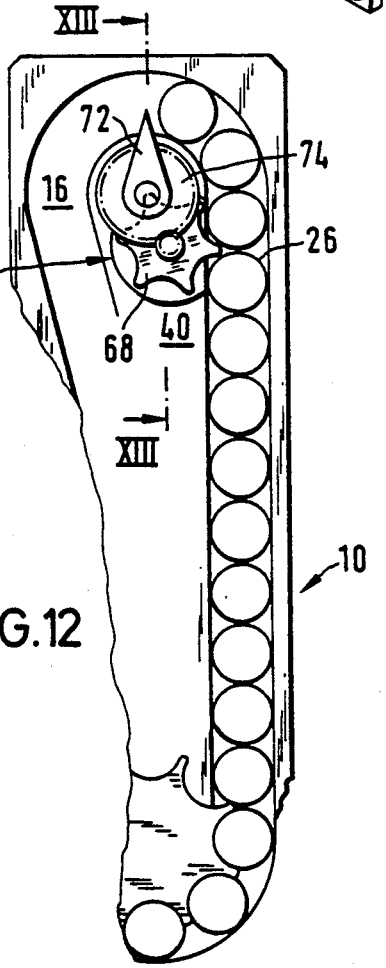
FIG. 12 is a front elevational view of a part of the preferred embodiment, showing further details.
Figure 13:
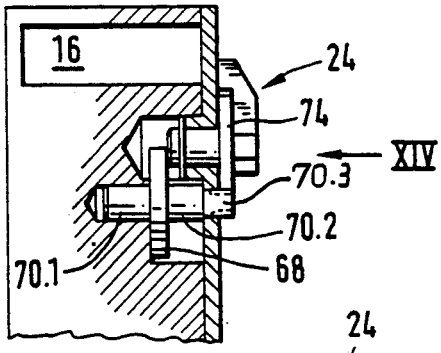
FIG. 13 is a sectional view taken along line XIII—XIII of FIG. 12.
Figure 14:
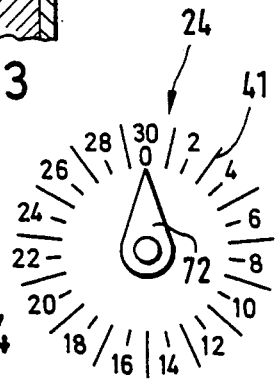
FIG. 14 is a view of a component of FIG. 13, as seen in the direction of arrow XIV of FIG. 13.

A register or counter 24, as shown in FIGS. 12, 13 and 14, is disposed in a space-saving manner within the interior space 40 enclosed by the endless guide channel 16 in the propellant igniter magazine 10. The register 24 has a star wheel 68 which has a portion for partially surrounding at least one casing 26 for being turned in a stepwise positive manner as that casing advances. The star wheel 68 is rotatably carried by two stub axles 70.1, 70.2 on opposite sides thereof. The stub axle 70.2 is configured as a gear 70.3 which engages a gear 74 carrying a pointer 72. The gear ratio between the gears 70.3 and 74 is selected so that after all the casings 26 within the magazine 10 have passed by the star wheel 68, the pointer 72 has completed one entire revolution. Accordingly, an error-free accounting of all ignited, as well as available, propellant igniters 14 (for example, 0 to 30) is shown on dial 41 of the register 24 at any time.

It will be understood that the above description of the present invention is susceptible to various modifications, changes and adaptations, and the same are intended to be comprehended within the meaning and range of equivalents of the appended claims.

What is claimed is:

1. A gun comprising:

(a) a gun barrel having a breech end;

(b) a wedge-type breechblock disposed at said breech end;

(c) a flash bore in said breechblock; said flash bore having an inlet opening;

(d) sealing means disposed adjacent to and surrounding said inlet opening;

(e) a propellant igniter magazine removably receivable in said breechblock and including a housing and an endless guide channel being defined in said housing;

(f) a plurality of casings received in said endless guide channel, said casings being arranged in a side-by-side contacting relationship with one another; each casing having opposite open ends and chamber means for receiving a propellant igniter cartridge therein;

(g) advancing means for step-wise advancing said plurality of casings in said endless guide channel for moving each said casing into and out of a firing position in which a respective said casing is in alignment with said flash bore and in engagement with said sealing means, said advancing means including:

(1) a star-shaped control wheel rotatably attached to said magazine, a plurality of radially extending grooves defined in said control wheel, a plurality of axially parallel locking notches defined in said control wheel, said control wheel having a plurality of axially oriented troughs arranged in a circumferential array for engaging and advancing said casings in said endless guide channel;

(2) a positioning member resiliently attached to said propellant igniter magazine adjacent to said guide channel for sequentially biasing said casings into engagement with consecutive said troughs as the control wheel rotates;

(3) a ratchet mounted on said control wheel for rotation relative thereto;

(4) guide means attached to said breech end for rotating said ratchet when said breechblock is moved;

(5) axially displaceable torque-transmitting members carried by said ratchet and arranged for projecting into said grooves of said control wheel for advancing said control wheel as the ratchet rotates; and (5) a stop movably mounted in said propellant igniter magazine and arranged for projecting into one of said axially parallel locking notches, said stop engaging a next-following one of said locking notches during advancement of said plurality of casings by said control wheel, and said stop maintaining engagement with the next-following locking notch and restraining said control wheel until said torque-transmitting members and said ratchet have returned to their starting positions;

(h) a register attached to said magazine for counting each spent propellant igniter; said register being mounted on said propellant igniter magazine within a space surrounded by said endless guide channel; and (i) a firing mechanism mounted on said breechblock, said firing mechanism being arranged to ignite the propellant igniter cartridge contained in the casing that dwells in the firing position, whereby a propellant igniting flame passes from the cartridge through the flash bore.

2. A gun as recited in claim 1, wherein each said casing has a ring-shaped, radially extending sealing surface arranged to engage said sealing means when said casing is in the firing position, and each said casing having a length and a constant outside diameter along said length.

3. A gun as recited in claim 2, wherein said flash bore includes a detonating channel insert having a detonating channel therethrough; said sealing means is disposed in said detonating channel; a cross-sectionally L-shaped ring obturator having first and second flanges; the first flange being disposed in said sealing means, and the second flange being adjacent to and spaced from the sealing surface of the casing situated in the firing position and being arranged to engage said sealing surface when gas pressure is developed in said detonating channel by the propellant igniting.

4. A gun as recited in claim 3, wherein the distance between said second flange and sealing surface of the casing in the firing position is a maximum of 0.5 mm in the absence of gas pressure in said detonating channel;

an outwardly opening angle being defined between said second flange and said sealing surface of the casing in said firing position and in the absence of gas pressure is in said detonating channel;

the ratio of the inner diameter of said ring obturator to the outer diameter of said ring obturator being in the range of about 0.35 to 0.5; and the wall thickness of said second flange of said ring obturator being in the range of about 0.8 to 1.2 mm.

5. A gun as recited in claim 1, wherein said positioning member comprises a leaf spring oriented in the direction of advancement of said plurality of casings within said endless guide channel.

6. A gun as recited in claim 1, further comprising a ratchet housing for said ratchet; a set screw being held in said ratchet housing; said control wheel having a stub axle; said ratchet housing being rotatably mounted on said slide bearing; said torque-transmitting members of said advancing means comprise pins arranged diametrically with respect to said stub axle within said ratchet housing; an inner face of each said pin contacting a compression spring and an outer face of each said pin engaging one of said grooves of said control wheel; a part of a longitudinal surface of each said pin slidably engaging one of said grooves of said control wheel, and another part of the longitudinal surface having a substantially flat guide surface for engaging said set screw for preventing a rotation of each said pin.

7. A gun as recited in claim 6, further comprising a pair of adjustable stops attached to said propellant igniter magazine on opposed sides of said ratchet for determining and limiting end positions of said ratchet; and a spring element being attached to said propellant igniter magazine and to said ratchet for causing said ratchet to positively return to its starting position abutting one of said pair of stops.

8. A gun as recited in claim 1, wherein said endless guide channel has a substantially rectangular cross section.

9. A gun as recited in claim 1, further comprising a handle hingedly attached to an upper end of said propellant igniter magazine at both sides thereof; said handle being adapted to assume a pivoted position in which it is substantially flush with the breechblock when said propellant igniter magazine is in a fully inserted operating position in said breechblock.

10. A gun as recited in claim 1, further comprising a fastener for releasably securing an upper face of said propellant igniter magazine to said breechblock.

11. A gun as recited in claim 1, wherein said register includes a star wheel for at least partially engaging one of said plurality of casings; a first gear attached to said star wheel; a second gear rotatably attached to said propellant igniter magazine housing; a pointer fixedly attached to said second gear for rotation therewith; the gear ratio between said first gear and said second gear being selected for causing said pointer to complete one revolution after each said casing has advanced through said endless guide channel and has engaged said star wheel one time.

12. A gun comprising:

a gun barrel having a breech end;

a wedge-type breechblock disposed at said breech end;

a flash bore in said breechblock; said flash bore having an inlet opening;

sealing means disposed adjacent to and surrounding said inlet opening;

a firing mechanism mounted on said breechblock;

a propellant igniter magazine removably receivable in said breechblock and including a housing and an endless guide channel defined in said housing;

a plurality of casings received in said endless guide channel, said casings being arranged in a side-by-side contacting relationship with one another; each casing having opposite open ends and chamber means for receiving a propellant igniter cartridge therein; and advancing means for step-wise advancing said plurality of casings in said endless guide channel for moving each said casing into and out of a firing position in which a respective said casing is in alignment with said flash bore and in engagement with said sealing means; said firing mechanism being arranged to ignite the propellant igniter cartridge contained in the casing that dwells in the firing position, whereby a propellant igniting flame passes from the cartridge through the flash bore.

* * * * *